US010309678B2

(12) United States Patent
Hinokuma et al.

(10) Patent No.: US 10,309,678 B2
(45) Date of Patent: Jun. 4, 2019

(54) AIR CONDITIONING SYSTEM

(71) Applicant: DAIKIN INDUSTRIES, LTD., Osaka-shi, Osaka (JP)

(72) Inventors: Ryohei Hinokuma, New York, NY (US); Hirotada Yamada, Osaka (JP); Yoshiyuki Uemura, Houston, TX (US)

(73) Assignee: Daikin Industries, Ltd., Osaka (JP)

( * ) Notice: Subject to any disclaimer, the term of this patent is extended or adjusted under 35 U.S.C. 154(b) by 221 days.

(21) Appl. No.: 14/933,523

(22) Filed: Nov. 5, 2015

(65) Prior Publication Data

US 2016/0131379 A1 May 12, 2016

Related U.S. Application Data

(60) Provisional application No. 62/076,574, filed on Nov. 7, 2014.

(51) Int. Cl.
*F24F 11/62* (2018.01)
*F24F 11/30* (2018.01)
(Continued)

(52) U.S. Cl.
CPC ..... *F24F 11/62* (2018.01); *F24F 11/30* (2018.01); *F24F 11/46* (2018.01); *F24F 11/61* (2018.01);
(Continued)

(58) Field of Classification Search
CPC ..... F24F 11/001; F24F 11/006; F24F 2011/0073; F24F 2011/0075;
(Continued)

(56) References Cited

U.S. PATENT DOCUMENTS 3,872,286 A * 3/1975 Putman ..... G06Q 50/06 705/412
4,141,069 A * 2/1979 Fox ..... H02J 3/14 307/52

FOREIGN PATENT DOCUMENTS

JP S5640036 A * 4/1981
JP 2000179911 A * 6/2000
(Continued)

OTHER PUBLICATIONS

Kawagishi et al., Air Conditioner, Jul. 27, 2001, JP2001201138A, Whole Document.*
(Continued)

*Primary Examiner* — Larry L Furdge
(74) *Attorney, Agent, or Firm* — Global IP Counselors, LLP

(57) ABSTRACT

An air conditioning system includes an air conditioner run by electric power, a storage battery, a demand receiver, an air-conditioning controller and a control selector. The storage battery charges electric power and supplies stored electric power to the air conditioner. The demand receiver receives a demand pertaining to a power consumption of the air conditioner during a predetermined period. The air-conditioning controller performs air-conditioning restriction control, which is preset when there is a need to restrict operation of the air conditioner in order to satisfy the demand, even when electric power is supplied from the storage battery to the air conditioner in the predetermined period. The control selector enables selection of the air-conditioning restriction control from among a plurality of control patterns.

10 Claims, 6 Drawing Sheets

(51) Int. Cl.

| | |
|---|---|
| *F24F 110/00* | (2018.01) |
| *F24F 140/50* | (2018.01) |
| *F24F 140/60* | (2018.01) |
| *F24F 11/63* | (2018.01) |
| *F24F 11/61* | (2018.01) |
| *F24F 11/46* | (2018.01) |

(52) U.S. Cl.
CPC ..... *F24F 11/63* (2018.01); *F24F 2110/00* (2018.01); *F24F 2140/50* (2018.01); *F24F 2140/60* (2018.01)

(58) Field of Classification Search
CPC ..... F24F 2011/0061; F24F 2011/0046; F24F 2011/0047
See application file for complete search history.

(56) References Cited

FOREIGN PATENT DOCUMENTS

| | | | |
|---|---|---|---|
| JP | 2001-201138 A | | 7/2001 |
| JP | 2001201138 A | * | 7/2001 |

OTHER PUBLICATIONS

Fukao, Duty Cycling Device, Apr. 16, 1981, JPS5640036A, Whole Document.*
Maruke et al., Air Conditioner, Jun. 30, 2000, JP2000179911A, Whole Document.*

* cited by examiner

AIR CONDITIONING SYSTEM

FIELD OF THE INVENTION

The present invention relates to an air conditioning system. More specifically, the present invention relates to an air conditioning system including an air conditioner run by electric power, and a storage battery for charging electric power and supplying stored electric power to the air conditioner.

BACKGROUND

As is indicated in Japanese Laid-open Patent Application No. 2001-201138, there is a known system including an air conditioner and a storage battery, in which, when a request (demand) for a peak cut is received from an electric power company or the like that supplies electric power to the system from outside, the air conditioner is operated by using the electric power of the storage battery charged during times such as the night so as to ensure the comfort of the user of the air conditioner while complying with the request.

Furthermore, Japanese Laid-open Patent Application No. 2001-201138 discloses that, when the demand cannot be met merely by utilizing the storage battery, the demand is met by reducing the operating capacity of the air conditioner from the operating capacity desired by the user to a capacity that can meet the demand by utilizing the storage battery.

SUMMARY

However, Japanese Laid-open Patent Application No. 2001-201138 does not disclose how the operating capacity of the air conditioner is reduced when the demand cannot be met merely by utilizing the storage battery.

Reducing the operating capacity of the air conditioner compromises the comfort of the user, but user's desires for air conditioning are diverse depending on individual lifestyle and other factors, and if the operating capacity of the air conditioner can be reduced so as to individually adapt to diversity, the loss of comfort can be suppressed.

The purpose of the present invention is to provide an air conditioning system in which electric power stored in a storage battery is utilized for an air conditioner in accordance with a demand, wherein the loss of comfort of the user of the air conditioner can be suppressed even when the capacity of the air conditioner is reduced below the operating capacity desired by the user in order to meet the demand.

An air conditioning system according to a first aspect of the present invention is provided with an air conditioner, a storage battery, a demand receiver, an air-conditioning controller, and a control selector. The air conditioner is run by electric power. The storage battery is configured to charge electric power and to supply stored electric power to the air conditioner. The demand receiver is configured to receive a demand pertaining to a power consumption of the air conditioner during a predetermined period. The air-conditioning controller is configured to perform air-conditioning restriction control which is preset when there is a need to restrict the operation of the air conditioner in order to satisfy the demand, even when electric power is supplied from the storage battery to the air conditioner in the predetermined period. The control selector is configured to enable the selection of the air-conditioning restriction control from among a plurality of control patterns.

In the air conditioning system according to the first aspect of the present invention, because air-conditioning restriction control, which is executed when the operation of the air conditioner needs to be restricted for complying a demand, is selected in advance from a plurality of control patterns, loss of user comfort can be suppressed according to diverse user's desire.

An air conditioning system according to a second aspect of the present invention is the air conditioning system according to the first aspect, wherein the plurality of control patterns include a first control pattern in which a period when operation of the air conditioner is not restricted is provided in the predetermined period.

In the air conditioning system according to the second aspect of the present invention, because a period when operation of the air conditioner is not restricted is provided even within the predetermined period in a case when the first control pattern is selected as the air-conditioning restriction control, the loss of user comfort can be suppressed according to diverse user's desires.

An air conditioning system according to a third aspect of the present invention is the air conditioning system according to the first or second aspect, wherein the plurality of control patterns include a second control pattern in which an amount of electric power supplied by the storage battery to the air conditioner is kept constant during the predetermined period.

In the air conditioning system according to the third aspect of the present invention, when the second control pattern is selected as the air-conditioning restriction control, rapid change in the temperature of the space being air-conditioned can be suppressed, and loss of comfort of a user, who does not desire sudden changes in temperature, can be suppressed.

An air conditioning system according to a fourth aspect of the present invention is the air conditioning system according to any of the first through third aspects, is further provided with an operation condition perceiver and an optimizer. The operation condition perceiver is configured to perceive an operation condition of the air conditioner during the predetermined period. The optimizer is configured to perform optimization of the air-conditioning restriction control based on the operation condition during the predetermined period.

In the air conditioning system according to the fourth aspect, because optimization of the air-conditioning restriction control is performed based on the operation condition of the air conditioner during the predetermined period, it is particularly easy to suppress loss of user comfort while meeting the demand.

In the air conditioning system according to the first aspect of the present invention, because air-conditioning restriction control, which is executed when the operation of the air conditioner needs to be restricted for complying with a demand, is selected in advance from a plurality of control patterns, loss of user comfort can be suppressed according to diverse user's desire.

In the air conditioning system according to the second and third aspects of the present invention, loss of user comfort can be suppressed as much as possible.

In the air conditioning system according to the fourth aspect of the present invention, it is particularly easy to suppress loss of user comfort while meeting the demand.

DETAILED DESCRIPTION OF EMBODIMENT(S)

Embodiments of the present invention are described below with reference to the drawings. The following embodiments are merely examples, and can be modified as appropriate provided that no departure is made from the scope of the invention.

First Embodiment

Figure 1:
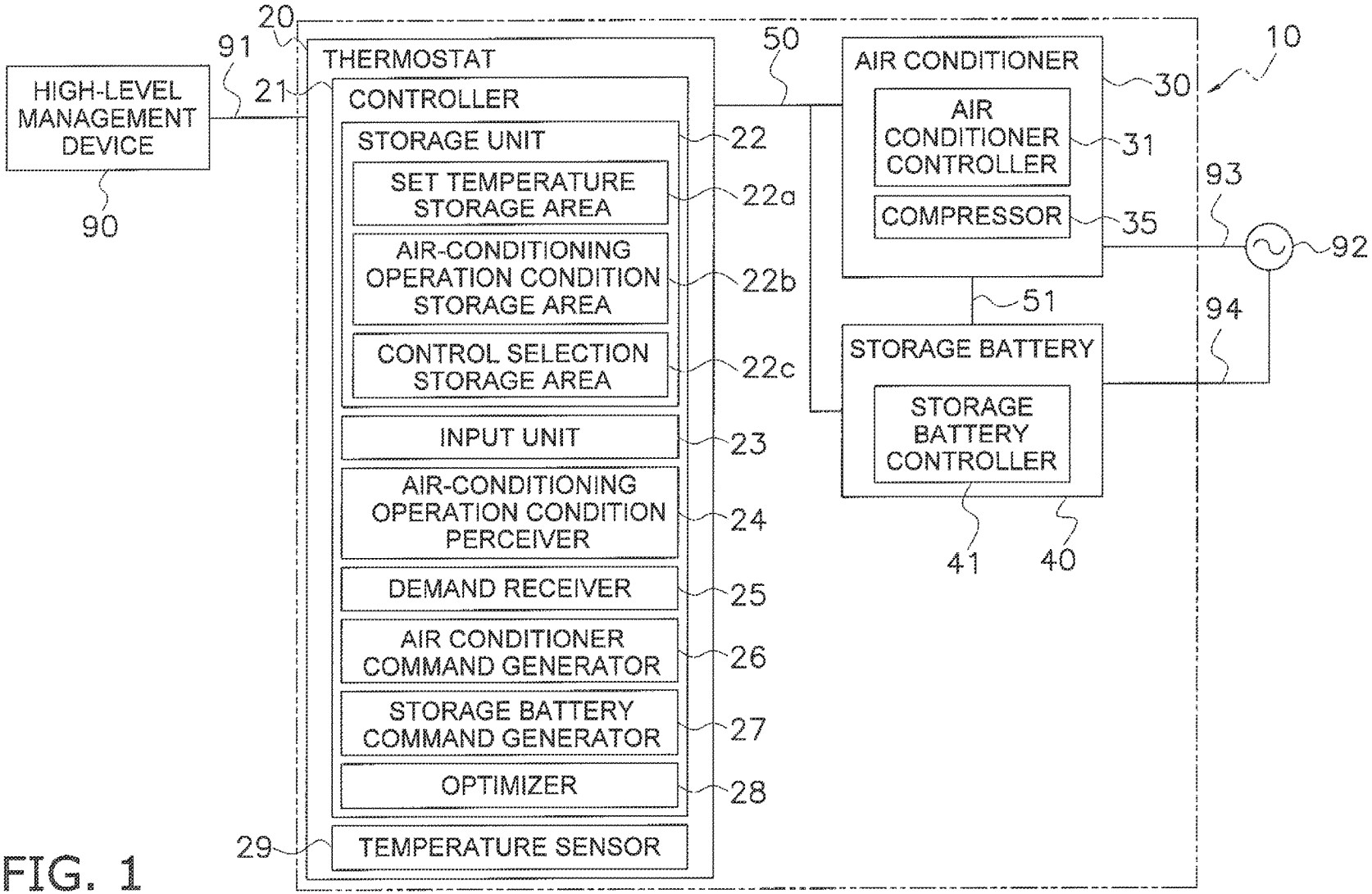
FIG. 1 is an overall schematic diagram of an air conditioning system according to an embodiment of the present invention.

FIG. 1 is an overall schematic diagram of an air conditioning system 10 according to an embodiment of the present invention. The air conditioning system 10 is installed in a home in this embodiment. The air conditioning system 10 is not limited to a home and may also be installed in a commercial building, a factory, or the like.

The air conditioning system 10 is primarily provided with a thermostat 20, an air conditioner 30, and a storage battery 40 (see FIG. 1).

In the air conditioning system 10, during a normal period (a period that is not a demand object period described hereinafter), electric power supplied from an electric power company is directly utilized (i.e. electric power stored in the storage battery 40 is not utilized) to operate the air conditioner 30 at the air-conditioning capacity desired by the user so that the temperature of the space being air-conditioned by the air conditioner 30 reaches a set temperature stored in the thermostat 20. The air conditioner 30 being operated at the air-conditioning capacity desired by the user means that the air conditioner 30 is operated within a usable range of the air conditioner 30 (i.e., a range equal to or less than the maximum electric power allowed by the design of the air conditioner 30) without a restriction on power consumption.

In the air conditioning system 10, during the demand object period (a period requested from the high-level management device 90 (see FIG. 1) to suppress the power consumption of the air conditioner 30), the electric power stored in the storage battery 40 is utilized, either in addition to electric power from the electric power company or instead of electric power from the electric power company, essentially to operate the air conditioner 30 at the air-conditioning capacity desired by the user so that the temperature of the space being air-conditioned by the air conditioner 30 reaches the set temperature stored in the thermostat 20. When the operation of the air conditioner 30 needs to be regulated in order to satisfy the demand pertaining to the power consumption of the air conditioner 30 even if electric power is supplied from the storage battery 40 to the air conditioner 30 during the demand object period, air-conditioning restriction control is performed. In other words, when a period in which the air conditioner 30 cannot be operated at the air-conditioning capacity desired by the user arises between the start and the end of the demand object period even if all of the electricity stored in the storage battery 40 is utilized, air-conditioning restriction control, in which a restriction is imposed on the power consumption of the air conditioner 30 during at least part of the demand object period, is performed.

(2) Details

The details of the air conditioning system 10 are described below.

(2-1) Thermostat

The thermostat 20 has a temperature sensor 29 (see FIG. 1) and measures the temperature of the space being air-conditioned by the air conditioner 30 using the temperature sensor 29. The thermostat 20 essentially sends a command to the air conditioner 30 so that the temperature of the space being air-conditioned by the air conditioner 30 (i.e., the temperature measured by the temperature sensor 29) reaches a set temperature stored in a set temperature storage area 22*a* (see FIG. 1), described hereinafter. The temperature sensor 29 is, for example, a thermistor, but is not limited thereto. Various temperature measuring instruments capable of measuring room temperatures can be applied as the temperature sensor 29.

The thermostat 20 is connected by a communication line 91 with the high-level management device 90 of an electric power company, an electric power aggregator, or the like (see FIG. 1). The communication line 91 is, for example, an Internet line, but is not limited thereto. FIG. 1 depicts the high-level management device 90 as being connected with only one thermostat 20, but in practice the high-level management device 90 may be connected by the communication line 91 with numerous thermostats. The thermostat 20 is also connected by a communication line 50 with the air conditioner 30 and the storage battery 40 of the air conditioning system 10. The communication line 50 is, for example, a dedicated control line, but is not limited thereto. For example, the communication line 50 may be a wireless LAN or the like.

The thermostat 20 has a controller 21 for performing tasks such as creating commands for the air conditioner 30 and the storage battery 40 (see FIG. 1). The controller 21 includes a storage unit 22 (see FIG. 1) configured primarily from read only memory (ROM), random access memory (RAM), and the like. The controller 21 also includes an input unit 23 (see FIG. 1) which receives various inputs from the user. The input unit 23 may be, for example, buttons, dials, and/or the like for receiving the user's inputs. The input unit 23 may be a touch panel. The input unit 23 may be an interface that enables connection with Internet line, and may receive inputs from a personal computer or the like outside the air conditioning system 10. The controller 21 also has a CPU (not shown), and the CPU functions primarily as an air-conditioning operation condition perceiver 24, a demand receiver 25, an air conditioner command generator 26, a storage battery command generator 27, and an optimizer 28 (see FIG. 1) by executing programs stored in the storage unit 22.

The storage unit 22, the input unit 23, the air-conditioning operation condition perceiver 24, the demand receiver 25, the air conditioner command generator 26, the storage battery command generator 27, and the optimizer 28 are described in detail below.

(2-1-1) Storage Unit

The storage unit 22 stores the programs executed by the CPU (not shown) of the controller 21. The storage unit 22 has the set temperature storage area 22*a*, a air-conditioning operation condition storage area 22*b*, and a control selection storage area 22*c*.

(2-1-1-1) Set Temperature Storage Area

Set temperatures of the air conditioner 30, i.e., target temperatures of the space being air-conditioned by the air conditioner 30 are stored in advance according to day of week and time in the set temperature storage area 22*a*. The set temperatures of the air conditioner 30 stored in the set temperature storage area 22*a* are inputted in advance, for example, by a user of the air conditioner 30 via an input unit 23. The set temperatures of the air conditioner 30 stored in the set temperature storage area 22*a* are configured to be updatable.

The set temperatures of the air conditioner 30 stored in the set temperature storage area 22*a* need not be information according to day of week and time. For example, the set temperatures of the air conditioner 30 stored in the set temperature storage area 22*a* may be information according to time irrespective of day of week. The set temperatures of the air conditioner 30 stored in the set temperature storage area 22*a* may also, for example, be information according to date and time.

(2-1-1-2) Air-Conditioning Operation Condition Storage Area

The air-conditioning operation condition storage area 22*b* stores information pertaining to the operation condition of the air conditioner 30. Specifically, information pertaining to the operation condition of the air conditioner 30, perceived by the air-conditioning operation condition perceiver 24 described hereinafter, is stored according to time in the air-conditioning operation condition storage area 22*b*.

(2-1-1-3) Control Selection Storage Area

The control selection storage area 22*c* stores control patterns which are selected by the user as air-conditioning restriction control described hereinafter and received by the input unit 23. The air-conditioning restriction control and the control patterns are described hereinafter.

(2-1-2) Input Unit

The input unit 23 receives input of information pertaining to the set temperature by a user or the like of the air conditioner 30. The set temperature received by the input unit 23 is stored in the set temperature storage area 22*a*. The input unit 23 also receives input of the control pattern selection by a user or the like of the air conditioner 30. In other words, the input unit 23 is an example of the control selector. The control patterns received by the input unit 23 are stored in the control selection storage area 22*c* as patterns of the air-conditioning restriction control selected by the user.

The air-conditioning restriction control and the control patterns are described herein.

The control in which the air conditioner 30 is operated at the air-conditioning capacity desired by the user, i.e., the control in which the air conditioner 30 is operated within the useable range of the air conditioner 30 (in other words, the range equal to or less than the maximum electric power allowed by the design of the air conditioner 30) without a restriction on power consumption, is referred to herein as normal control. In normal control, the air conditioner 30 is operated, for example, based on the degree of divergence between the room temperature and the set temperature of the air conditioner 30, and if necessary (if the degree of divergence is large) the air conditioner is operated at the maximum electric power allowed to the air conditioner 30. Normal control is control of the air conditioner 30 executed when the air conditioner command generator 26 assesses that the demand pertaining to the power consumption of the air conditioner 30 can be satisfied without restricting the operation of the air conditioner 30 if electric power is supplied from the storage battery 40 to the air conditioner 30, even during the demand object period as well as during the periods other than the demand object period.

Air-conditioning restriction control on the other hand is control of the air conditioner 30 executed when the air conditioner command generator 26 assesses that the operation of the air conditioner 30 needs to be restricted in order to satisfy the demand pertaining to the power consumption of the air conditioner 30 even if electric power is supplied from the storage battery 40 to the air conditioner 30, during the demand object period. In other words, air-conditioning restriction control is control of the air conditioner 30 executed when a period arises in which the air conditioner 30 cannot be operated at the air-conditioning capacity desired by the user between the start and end of the demand object period, even if all of the electricity stored in the storage battery 40 is utilized. When air-conditioning restriction control is executed, a restriction is imposed on the power consumption of the air conditioner 30 during at least part of the demand object period. When a restriction is imposed on the power consumption of the air conditioner 30, e.g., even if the air conditioner 30 needs to be operated at a predetermined electric power (e.g., maximum electric power) based on the degree of divergence between the room temperature and the set temperature of the air conditioner 30, the air conditioner 30 is operated with a power consumption which is kept less than the predetermined electric power.

Next, the control patterns will be described. The control patterns are patterns regarding how the above-described air-conditioning restriction control will be executed. In the air conditioning system 10, a plurality of control patterns that can be selected as the air-conditioning restriction control are prepared in advance. By providing a plurality of control patterns and enabling them to be selected by a user or the like, loss of user comfort can be suppressed even when the capacity of the air conditioner 30 is reduced below the air-conditioning capacity desired by the user in order to meet the demand pertaining to the power consumption of the air conditioner 30.

Specifically, the air conditioning system 10 has four control patterns as a plurality of selectable control patterns:

a desire-preceding pattern, an equalization pattern, a specific period emphasis pattern, and a desire follow-up pattern. A summary of these control patterns is described with reference to FIGS. 2A to 2D. FIGS. 2A to 2D show the changes over time in user's desire fulfillment rate when each control pattern is executed. The term "user's desire fulfillment rate" herein refers to a percentage of the actual air-conditioning capacity of the air conditioner 30 relative to the air-conditioning capacity desired by the user.

(a) Desire-preceding Pattern

Figure 2A:
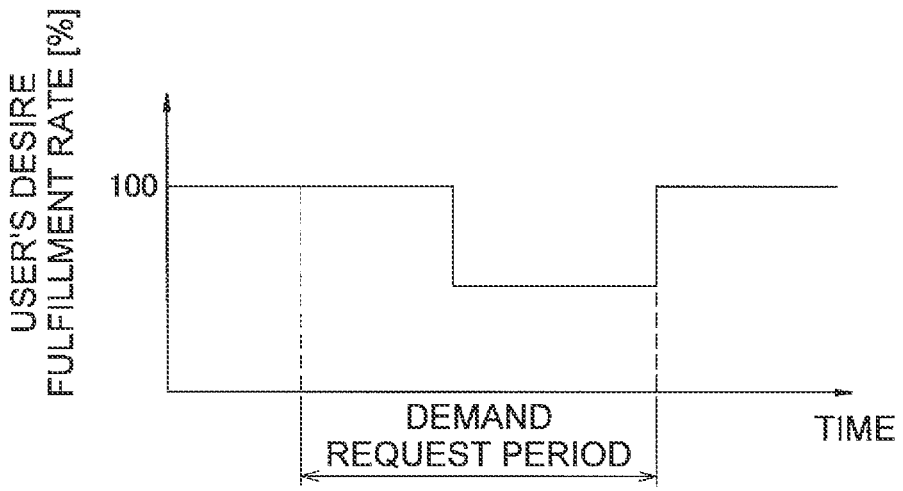
FIG. 2A, an example of a control pattern of the air-conditioning restriction control of the air conditioning system of FIG. 1, shows an example of change over time in user's desire fulfillment rate in a case when a control pattern (a desire-preceding pattern), that does not restrict the power consumption of the air conditioner from the starting time of the demand request period until the amount stored in the storage battery reaches 0, is executed.

The desire-preceding pattern is a control pattern in which the air conditioner 30 is operated at the air-conditioning capacity desired by the user from the start of the demand object period until the electricity stored in the storage battery 40 is all used up (see FIG. 2A). After the electricity stored in the storage battery is all used up, the air conditioner 30 is operated at a power consumption equal to or less than the electric power up to which the air conditioner 30 is allowed to use by the high-level management device 90 until the end of the demand object period.

(b) Equalization Pattern

Figure 2B:
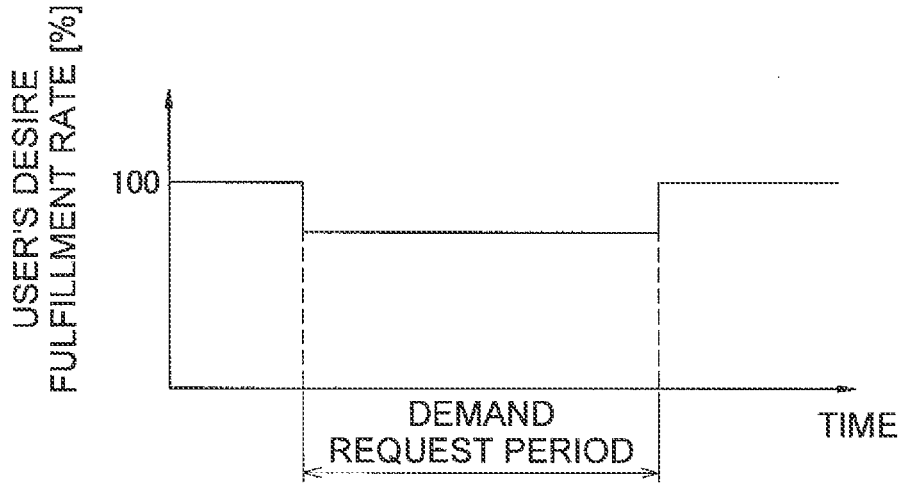
FIG. 2B, an example of a control pattern of the air-conditioning restriction control of the air conditioning system of FIG. 1, shows an example of change over time in user's desire fulfillment rate in a case when a control pattern (an equalization pattern), in which electric power is supplied from the storage battery to the air conditioner evenly through the entire demand request period, is executed.

The equalization pattern is a control pattern in which the electricity stored in the storage battery is supplied at a constant rate to the air conditioner 30 from the start to the end of the demand object period (see FIG. 2B).

(c) Specific Period Emphasis Pattern

Figure 2C:
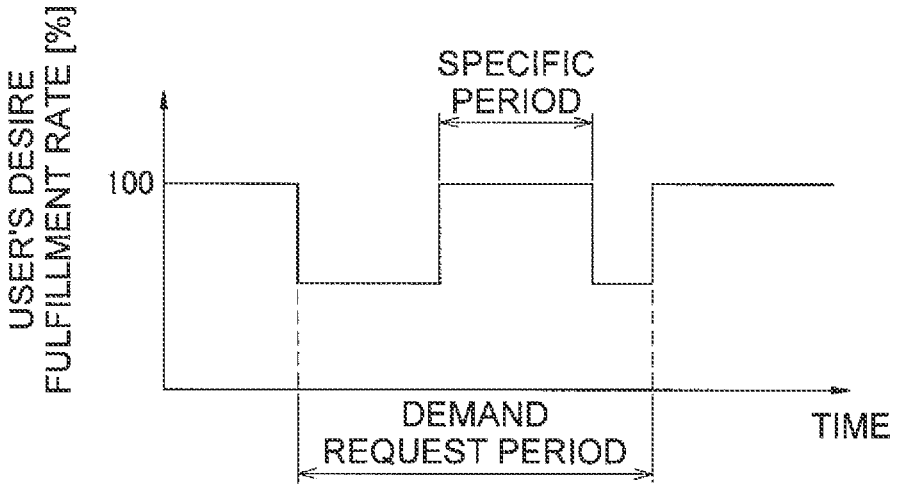
FIG. 2C, an example of a control pattern of the air-conditioning restriction control of the air conditioning system of FIG. 1, shows an example of change over time in user's desire fulfillment rate in a case when a control pattern (a specific period emphasis pattern), that does not restrict the power consumption of the air conditioner in a specific period within the demand request period, is executed.

The specific period emphasis pattern is a control pattern in which electricity stored in the storage battery is utilized so that the air conditioner 30 is operated at the air-conditioning capacity desired by the user only for a specific period (e.g., a specific time span) within the demand object period (see FIG. 2C). Except for the specific period, the air conditioner 30 is essentially operated at a power consumption equal to or less than the electric power up to which the air conditioner 30 is allowed to use by the high-level management device 90. When electricity stored in the storage battery 40 remains despite the air conditioner 30 being operated at the air-conditioning capacity desired by the user during the specific period, the electric power of the storage battery 40 is utilized even during times outside the specific period within the demand object period. Excess electric power may, for example, be supplied at a constant rate to the air conditioner 30 throughout the entire periods outside the specific period within the demand object period. Moreover, excess electric power may, for example, be supplied from the storage battery 40 to the air conditioner 30 in a period continuing from the specific period until the electricity stored in the storage battery 40 is all used up, so that the air conditioner 30 continues to operate at the air-conditioning capacity desired by the user.

(d) Desire Follow-Up Pattern

Figure 2D:
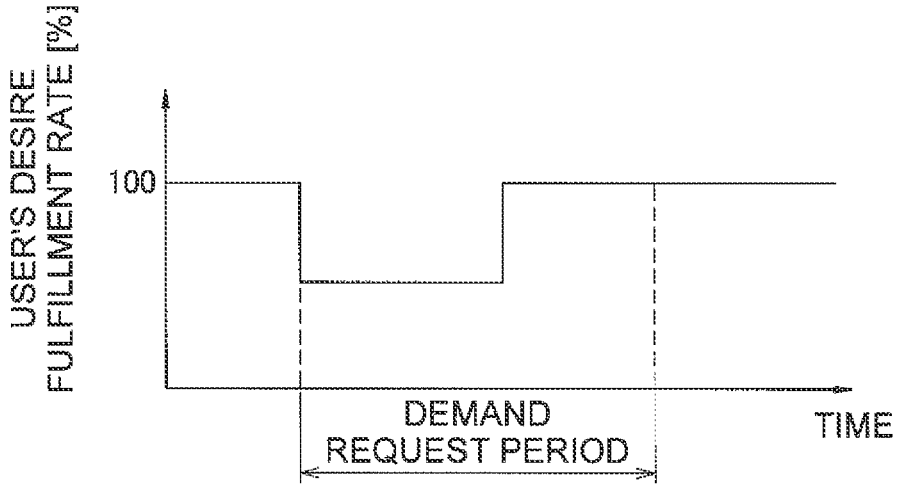
FIG. 2D, an example of a control pattern of the air-conditioning restriction control of the air conditioning system of FIG. 1, shows an example of change over time in user's desire fulfillment rate in a when a control pattern (a desire follow-up pattern), that does not restrict the power consumption of the air conditioner at the end of the demand request period, is executed.

The desire follow-up pattern is a control pattern in which the air conditioner 30 is operated at the air-conditioning capacity desired by the user when the demand object period ends (see FIG. 2D). In the desire follow-up pattern, electric power is supplied from the storage battery 40 to the air conditioner 30 so that the air conditioner 30 can be operated at the air-conditioning capacity desired by the user from a certain point in time within the demand object period, which is decided so that the electricity stored in the storage battery 40 will be all used up at the end of the demand object period, until the end of the demand object period. In the period until the start of storage battery 40 utilization within the demand object period, the air conditioner 30 is operated at a power consumption equal to or less than the electric power up to which the air conditioner 30 is allowed to use by the high-level management device 90.

(2-1-3) Air-Conditioning Operation Condition Perceiver

The air-conditioning operation condition perceiver 24 acquires information periodically transmitted from the air conditioner 30 via the communication line 50, and perceives this information as information pertaining to the operation condition of the air conditioner 30. The air-conditioning operation condition perceiver 24 acquires information pertaining to the operation condition of the air conditioner 30 every minute, but the interval of information acquisition is not limited to one minute. The air-conditioning operation condition perceiver 24 perceives information pertaining to the operation condition of the air conditioner 30 both during the demand request period and outside the demand request period.

The information pertaining to the operation condition of the air conditioner 30, perceived by the air-conditioning operation condition perceiver 24, includes, e.g., the set temperature of the air conditioner 30, the power consumption of the air conditioner 30, and the operating frequency of the compressor 35 of the air conditioner 30, described hereinafter. The information pertaining to the operation condition of the air conditioner 30 is not limited thereto. The air-conditioning operation condition perceiver 24 correlates the perceived information pertaining to the operation condition of the air conditioner 30 with the time of information acquisition, and stores the information in the air-conditioning operation condition storage area 22*b*.

(2-1-4) Demand Receiver

The demand receiver 25 receives a demand pertaining to the power consumption of the air conditioner 30 in a predetermined period (referred to hereinafter simply as the demand), which is transmitted from a high-level management device 90 of an electric power company, an electric power aggregator, or the like. Specifically, the demand is a request from the high-level management device 90 to suppress the power consumption of the air conditioner 30 in a predetermined period (a demand request period).

The demand includes the length of the demand request period, the start time of the demand request period, and the information pertaining to the reduction amount of the power consumption of the air conditioner 30 within the demand request period. The information pertaining to the reduction amount of the power consumption of the air conditioner 30 is the ratio of the electric power the air conditioner 30 is allowed to use during the demand request period relative to the maximum electric power of the air conditioner 30.

The demand is transmitted from the high-level management device 90 to the demand receiver 25 on, e.g., the day before the demand request period, but is not limited thereto. The demand may be transmitted from the high-level management device 90 to the demand receiver 25, e.g., several hours prior to the start time of the demand request period.

The information pertaining to the reduction amount of the power consumption of the air conditioner 30 is not limited to the ratio of the electric power the air conditioner 30 is allowed to use during the demand request period relative to the maximum electric power of the air conditioner 30. The information pertaining to the reduction amount of the power consumption of the air conditioner 30 may be, for example, a value of the electric power allowed to be used during the demand request period, a value of the electric power that should be reduced during the demand request period relative to the maximum electric power of the air conditioner 30, or other information through which it is possible to perceive how much the power consumption of the air conditioner 30 should be reduced during the demand request period.

The information pertaining to the reduction amount of the power consumption of the air conditioner 30 herein is information pertaining to electric power (a momentary value), but is not limited thereto. For example, the information pertaining to the reduction amount of the power consumption of the air conditioner 30 may be the ratio of the average electric power determined from the electric energy the air conditioner 30 is allowed to use in a predetermined time duration (e.g., 30 minutes) in the demand request period, relative to the maximum electric power of the air conditioner 30. The information pertaining to the reduction amount of the power consumption of the air conditioner 30 may also, for example, be the electric energy the air conditioner 30 is allowed to use in a predetermined time duration (e.g., 30 minutes) in the demand request period. The type of the information pertaining to the reduction amount of the power consumption of the air conditioner 30 is preferably determined as appropriate in the high-level management device 90.

(2-1-5) Air Conditioner Command Generator

The air conditioner command generator 26 switches a control of the air conditioner 30 between normal control and air-conditioning restriction control, and then executes the control. The air conditioner command generator 26 performs the normal control outside the demand request period. During the demand request period, the air conditioner command generator 26 executes either normal control or air-conditioning restriction control. The process of deciding the control implemented during the demand request period is described hereinafter.

During normal control, the air conditioner command generator 26 sends a command to an air conditioner controller 31 of the air conditioner 30, described hereinafter, so that the temperature of the space being air-conditioned by the air conditioner 30, i.e. the value measured by the temperature sensor 29, reaches the set temperature corresponding to the current day of week and time stored in the set temperature storage area 22*a*. Specifically, the air conditioner command generator 26 periodically (e.g., every minute) generates information including the current value measured by the temperature sensor 29 and the set temperature corresponding to the current day of week and time, as a command for the air conditioner controller 31, and transmits the information to the air conditioner controller 31.

When executing air-conditioning restriction control, the air conditioner command generator 26 classifies the demand request period into a period in which the air conditioner 30 is operated at the air-conditioning capacity desired by the user (referred to hereinafter as the power consumption unrestricted period), and a period in which the power consumption of the air conditioner 30 is restricted (referred to hereinafter as the power consumption restricted period), as will be described hereinafter. The air conditioner command generator 26 also calculates the maximum electric power allowed to the air conditioner 30 during the power consumption restricted period, as will be described hereinafter. The air conditioner command generator 26 then generates a command for the air conditioner controller 31 in the following manner and transmits the command to the air conditioner controller 31.

In the power consumption unrestricted period, the air conditioner command generator 26 periodically (e.g., every minute) generates information including the current value measured by the temperature sensor 29 and the set temperature corresponding to the current day of week and time, as a command for the air conditioner controller 31, and transmits this information to the air conditioner controller 31.

In the power consumption restricted period, the air conditioner command generator 26 periodically (e.g., every minute) generates information including the current value measured by the temperature sensor 29, the set temperature corresponding to the current day of week and time, and the maximum electric power allowed to the air conditioner 30, as a command for the air conditioner controller 31, and transmits this information to the air conditioner controller 31.

(2-1-6) Storage Battery Command Generator

The storage battery command generator 27 primarily generates a command for controlling the discharging of the storage battery 40.

The storage battery command generator 27 decides a period in which electric power will be supplied from the storage battery 40 to the air conditioner 30 (hereinafter referred to as the discharge period of the storage battery 40), as will be described hereinafter. Furthermore, the storage battery command generator 27 decides an amount of electric power that will be supplied from the storage battery 40 to the air conditioner 30 during the discharge period of the storage battery 40, as will be described hereinafter.

The storage battery command generator 27 periodically (e.g., every minute) generates information including the amount of electric power (the amount of discharge) that will be supplied from the storage battery 40 to the air conditioner 30 during the discharge period of the storage battery 40, as a command pertaining to the discharging of the storage battery 40, and transmits this information to the storage battery controller 41.

(2-1-7) Optimizer

The optimizer 28 performs optimization on the air-conditioning restriction control based on the operation condition of the air conditioner 30 perceived by the air-conditioning operation condition perceiver 24 and stored in the air-conditioning operation condition storage area 22*b*.

As will be described hereinafter, prior to the start of the demand request period, the air conditioner command generator 26 decides in advance the specifics of the air-conditioning restriction control, i.e., the power consumption unrestricted period and the power consumption restricted period within the demand request period, and/or the maximum electric power that will be allowed to the air conditioner 30 in the power consumption restricted period. As will be described hereinafter, prior to the start of the demand request period, the storage battery command generator 27 decides in advance the specifics of the storage battery discharge control, i.e., the discharge period of the storage battery 40 and/or the amount of discharge of the storage battery 40 during the discharge period. However, there are cases in which the power consumption during the demand request period deviates from the expected one because the operation of the air conditioner 30 is affected by various factors.

In view of this, the optimizer 28 perceives the actual power consumption of the air conditioner 30 based on the operation condition of the air conditioner 30 stored in the air-conditioning operation condition storage area 22*b*, and performs a reexamination of specifics of the air-conditioning restriction control and/or the specifics of the discharge control of the storage battery so that the comfort of the user can be maintained as much as possible, or so that the demand is satisfied. For example, specifically, when the power consumption of the air conditioner 30 is less than predicted and there is an excess in the amount stored by the storage battery 40, the discharge period of the storage battery 40 is extended and the power consumption unrestricted period is extended. Another example is when the power consumption of the air conditioner 30 is less than predicted and there is an excess in the amount stored by the storage battery 40, the electric power supplied from the storage battery 40 to the air conditioner 30 (the discharge amount) and the maximum electric power allowed to the air conditioner 30 during the power consumption restricted period are increased. Thus, due to the reexamination of the specifics of the air-conditioning restriction control and/or the specifics of the storage battery discharge control, the air-conditioning restriction control and the storage battery discharge control are optimized. The optimization process by the optimizer 28 is repeated at predetermined time intervals (e.g., every ten minutes) during the demand request period.

(2-2) Air Conditioner

The air conditioner 30 is connected by an electric power line 93 with a power source 92 (see FIG. 1) supplied by the electric power company. The air conditioner 30 is also connected with the storage battery 40 by an electric power line 51 (see FIG. 1). The air conditioner 30 runs by receiving a supply of electric power from the power source 92 supplied by the electric power company, and/or from the storage battery 40.

The air conditioner 30 is a vapor-compression air-conditioning apparatus. The air conditioner 30 is provided with an inverter-type compressor 35, indoor heat exchanger, outdoor heat exchanger, and expansion valve which are not shown. In the air conditioner 30, a refrigeration cycle is repeated in which refrigerant compressed by the compressor 35 releases heat in either the indoor heat exchanger or the outdoor heat exchanger, the refrigerant is depressurized in the expansion valve and evaporated in the other heat exchanger, and the refrigerant is drawn back into the compressor 35, whereby the space being air-conditioned is cooled or warmed. The air-cooling operation and air-warming operation of the air conditioner 30 are switched by controlling the direction of refrigerant flow and changing the use of the indoor heat exchanger between an evaporator and a condenser.

The air conditioner 30 has an air conditioner controller 31. The air conditioner controller 31 controls the air conditioner 30 in accordance with a command transmitted from the air conditioner command generator 26 of the thermostat 20. More specifically, when the command transmitted from the air conditioner command generator 26 does not include information pertaining to the maximum electric power allowed to the air conditioner 30, the air conditioner controller 31 controls the operating frequency and/or the turning on and off of the compressor 35 based on the degree of divergence between the current room temperature and the current set temperature, and/or the values measured by sensors provided to various locations of the air conditioner 30. When the command transmitted from the air conditioner command generator 26 includes information pertaining to the maximum electric power allowed to the air conditioner 30, the air conditioner controller 31 sets an operating frequency of the compressor at which the electric power does not exceed the transmitted maximum electric power allowed to the air conditioner 30 as a limit value. The air conditioner controller 31 then controls the operating frequency and/or the turning on and off of the compressor 35 based on the degree of divergence between the current room temperature and the current set temperature, and/or the values measured by the sensors provided to various locations of the air conditioner 30. When the operating frequency of the compressor 35, which is based on the degree of divergence between the current room temperature and the current set temperature and/or the values measured by the sensors provided to various locations of the air conditioner 30, exceeds the set limit value of the operating frequency; the operating frequency of the compressor 35 is suppressed to the limit value.

(2-3) Storage Battery

The storage battery 40 is connected by an electric power line 94 with the power source 92 of the electric power company. The storage battery 40 is also connected with the air conditioner 30 by the electric power line 51. The storage battery 40 charges electric power by receiving an electric power supply from the power source 92 supplied by the electric power company, and supplies the stored electric power to the air conditioner 30.

A lead storage battery, a lithium ion storage battery, a nickel metal hydride storage battery, an air battery, and various other storage batteries can be applied as the storage battery 40.

The storage battery 40 has a storage battery controller 41 for controlling the charging of the storage battery 40. The storage battery controller 41 controls the storage battery 40 so that the storage battery 40 is charged to a predetermined charged amount during a predetermined time span (e.g., a time span in which the power consumption of the air conditioner 30 is low).

The storage battery controller 41 receives a command from the storage battery command generator 27 to control the discharge of the storage battery 40. Specifically, information including the amount of electric power supplied from the storage battery 40 to the air conditioner 30 (the discharged amount) is transmitted from the storage battery command generator 27 to the storage battery controller 41 as a command pertaining to the discharge of the storage battery 40. The storage battery controller 41 supplies electric power to the air conditioner 30 based on the command of the storage battery command generator 27.

(3) Actions of Air Conditioning System (3-1) Control of Air Conditioner Outside Demand Request Period The control of the air conditioner 30 during periods outside the demand request period shall be described.

In the air conditioning system 10, set temperatures of the air conditioner 30 according to day of week and time are stored in the set temperature storage area 22*a* of the thermostat 20. The thermostat 20 periodically generates, as a command for the air conditioner controller 31, information including the current room temperature measured by the temperature sensor 29 and the set temperature corresponding to the current day of week and time stored in the set temperature storage area 22*a* for the air conditioner controller 31 of the air conditioner 30, and transmits this information to the air conditioner controller 31. The air conditioner controller 31 controls the operating frequency and/or the turning on and off of the compressor 35 of the air conditioner 30 based on the current room temperature and current set temperature transmitted from the thermostat 20, and the values measured by sensors provided to various locations of the air conditioner 30.

(3-2) Process of Deciding Control Implemented in Demand Request Period

Figure 3:
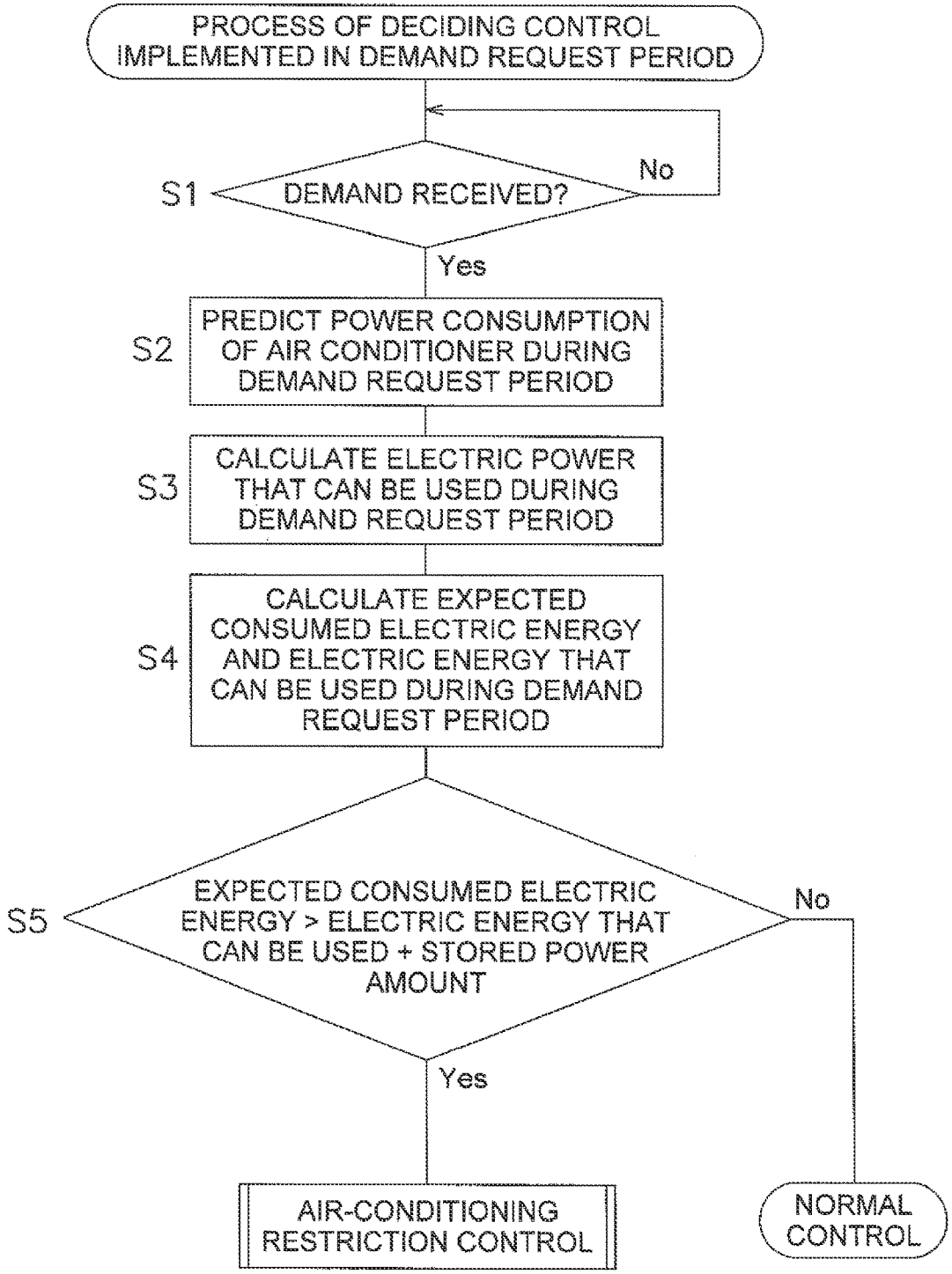
FIG. 3 is a flowchart of the decision process of the control performed in the demand request period, executed by an air conditioner command generator of the air conditioning system of FIG. 1.

The process of deciding the control implemented in the demand request period shall be described with reference to the flowchart of FIG. 3.

First, in step S1, a determination is made as to whether or not the demand receiver 25 has received a demand from the high-level management device 90. Step S1 is repeated until it is determined that the demand receiver 25 has received a demand. When it is determined that a demand has been received, the process advances to step S2.

In step S2, the air conditioner command generator 26 predicts the power consumption of the air conditioner 30 in the demand request period (the power consumption of the air conditioner 30 when the air conditioner 30 is operated at the set temperature scheduled for the demand request period). More specifically, the air conditioner command generator 26 predicts the power consumption of the air conditioner 30 in the demand request period based on the set temperature of the air conditioner 30 scheduled for the demand request period and information pertaining to past operation conditions of the air conditioner 30. For example, the air conditioner command generator 26 finds a plurality of times at which the set temperature value was equal to the set temperature of the air conditioner 30 in the demand request period from the information pertaining to past (e.g., during the demand request period on the previous day) operation conditions of the air conditioner 30, and calculates the average power consumption of the air conditioner 30 of those times to predict the power consumption of the air conditioner 30 in the demand request period. This is an example of the method by which the air conditioner command generator 26 predicts the power consumption of the air conditioner 30 in the demand request period, and the method is not limited thereto.

Next, in step S3, the air conditioner command generator 26 calculates the electric power that the air conditioner 30 can use during the demand request period (the maximum electric power supplied from the power source 92) based on the information pertaining to the reduction amount of the power consumption of the air conditioner 30, which was received by the demand receiver 25.

Here, step S3 is executed after step S2 is executed, but the execution sequence of these steps may be reversed. Steps S2 and S3 may be executed in parallel.

Next, in step S4, the air conditioner command generator 26 calculates the expected consumed electric energy of the entire demand request period from the power consumption of the air conditioner 30 in the demand request period expected in step S2. In step S4, the air conditioner command generator 26 also calculates the electric energy that can be used in the entire demand request period from the electric power that the air conditioner 30 can use during the demand request period, which was calculated in step S3.

Next, in step S5, the air conditioner command generator 26 determines whether or not the expected consumed electric energy of the entire demand request period calculated in step S4 is greater than the sum of the electric energy that can be used in the entire demand request period, calculated in step S4, and the amount stored in the storage battery 40.

If the expected consumed electric energy in the entire demand request period is determined to be greater than the sum of the amount of electric energy that can be used in the entire demand request period and the amount stored in the storage battery 40, the air conditioner command generator 26 selects air-conditioning restriction control. If the expected consumed electric energy in the entire demand request period is determined to be equal to or less than the sum of the amount of electric energy that can be used in the entire demand request period and the amount stored in the storage battery 40, the air conditioner command generator 26 selects normal control.

(3-3) Air-conditioning Restriction Control

Figure 4:
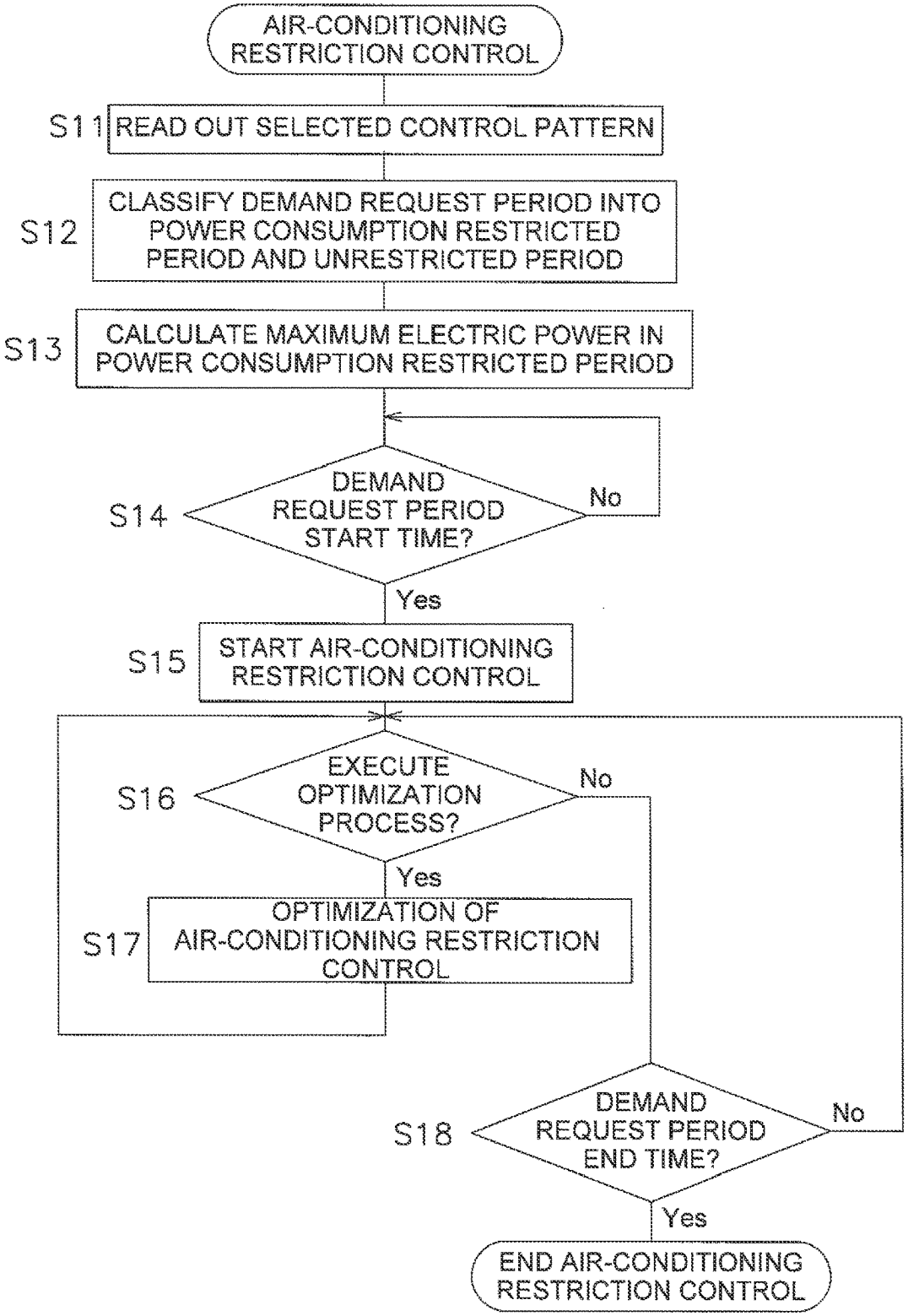
FIG. 4 is a flowchart of the air-conditioning restriction control of the air conditioning system of FIG. 1.

Air-conditioning restriction control shall be described with reference to the flowchart of FIG. 4.

Upon deciding that air-conditioning restriction control will be executed in the demand request period, the air conditioner command generator 26 reads out the control pattern stored in the control selection storage area 22*c* (step S11).

Next, in step S12, the air conditioner command generator 26 classifies the demand request period into a power consumption restricted period and a power consumption unrestricted period (a period in which the air conditioner 30 is operated at the air-conditioning capacity desired by the user), based on the read control pattern.

If, for example, the read control pattern is the desire-preceding pattern (see FIG. 2A), the period classified as a power consumption unrestricted period is a period of time from the start of the demand object period until the elapse of a time duration obtained by dividing the amount stored in the storage battery 40 by the difference between the expected power consumption calculated in step S2 described above and the electric power that the air conditioner 30 can use in the demand object period calculated in step S3 described above. The remaining period is classified as a power consumption restricted period. If, for example, the read control pattern is the equalization pattern (see FIG. 2B), the entire demand object period is classified as a power consumption restricted period. If, for example, the read control pattern is the specific period emphasis pattern (see FIG. 2C), a specific period established in advance is classified as a power consumption unrestricted period, and the remaining period is classified as a power consumption restricted period (to simplify the description herein, it is assumed that the amount of power stored in the storage battery 40 is entirely used up in the specific period). If, for example, the read control pattern is the desire follow-up pattern (see FIG. 2D), the period classified as a power consumption unrestricted period is a period of a time duration which is obtained by dividing the amount stored in the storage battery 40 by the difference between the expected power consumption calculated in step S2 described above and the electric power that the air conditioner 30 can use in the demand object period calculated in step S3 described above immediately prior to the end of the demand object period. The remaining period is classified as a power consumption restricted period.

Next, in step S13, the air conditioner command generator 26 calculates the maximum electric power allowed in the power consumption restricted period, based on the read control pattern. For example, if the read control pattern is the desire-preceding pattern, the specific period emphasis pattern, or the desire follow-up pattern, the maximum electric power allowed in the power consumption restricted period is equal to the electric power that the air conditioner 30 can use in the demand object period, calculated in step S3 described above. If, for example, the read control pattern is the equalization pattern, the maximum electric power allowed in the power consumption restricted period is equal to the sum of the quotient of the amount stored in the storage battery 40 divided by the length of the demand request period, and the electric power the air conditioner 30 can use in the demand object period calculated in step S3.

The initial operation requirement of air-conditioning restriction control is decided in the above manner.

Next, in step S14, a determination is made as to whether or not it is time to start the demand request period. Step S14 is repeated until it is determined that it is time to start the demand request period.

When it is determined that it is time to start the demand request period, the process advances to step S15, and air-conditioning restriction control is started. Air-conditioning restriction control is executed continuously until it is determined in step S18, described hereinafter, that the demand request period has ended. When air-conditioning restriction control is started, the air conditioner command generator 26 generates a command for the air conditioner controller 31 in accordance with the specifics decided in steps S12 and S13, and transmits this command to the air conditioner controller 31.

Next, in step S16, a determination is made as to whether or not it is time for the optimizer 28 to execute the optimization process of air-conditioning restriction control. Specifically, in step S16, a determination is made as to whether or not a predetermined period has elapsed since the start of the demand request period or since the previous optimization process was performed. If it is determined that the predetermined period has elapsed, the process advances to step S17 and the optimization process of air-conditioning restriction control is performed by the optimizer 28. In step S17, the power consumption unrestricted period, the power consumption restricted period, and the maximum electric power allowed in the power consumption restricted period, decided in steps S12 and/or S13 (or thereafter optimized) are reexamined. The result of the reexamination by the optimizer 28 is reflected in the air-conditioning restriction control executed by the air conditioner command generator 26. After step S17 ends, the process returns to step S16.

When it is determined in step S16 that it is not the time for the optimizer 28 to execute the optimization process of air-conditioning restriction control, the process advances to step S18. In step S18, it is determined whether or not it is time for the demand request period to end. If it is determined that it is time for the demand request period to end, the air-conditioning restriction control is ended and a transition is made to the normal control. If it is determined in step S18 that it is not time for the demand request period to end, the process returns to step S16.

(3-4) Storage Battery Discharge Control

Figure 5:
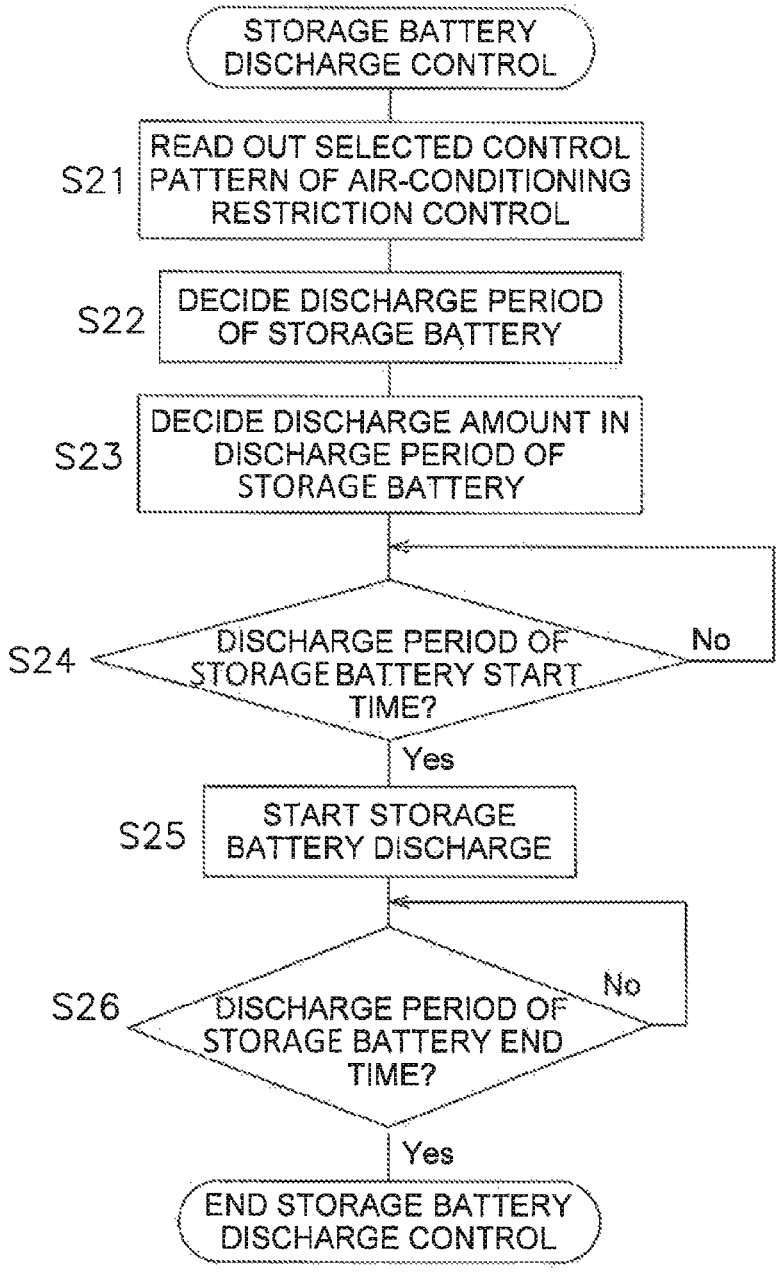
FIG. 5 is a flowchart of the storage battery discharge control of the air conditioning system of FIG. 1.

Discharge control of the storage battery 40 during air-conditioning restriction control execution shall be described with reference to the flowchart of FIG. 5. Discharge control of the storage battery 40 is executed in parallel with the air-conditioning restriction control described above.

When it is decided that air-conditioning restriction control will be executed in the demand request period, the storage battery command generator 27 reads out the control pattern for air-conditioning restriction control stored in the control selection storage area 22*c* (step S21).

Next, in step S22, the storage battery command generator 27 decides the discharge period of the storage battery 40 during the demand request period based on the read control pattern. If, for example, the read control pattern is the desire-preceding pattern (see FIG. 2A), the discharge period of the storage battery 40 is decided as a period of time from the start of the demand object period until the elapse of a time duration obtained by dividing the amount stored in the storage battery 40 by the difference between the expected power consumption calculated in step S2 described above and the electric power that the air conditioner 30 can use in the demand object period calculated in step S3 described above. If, for example, the read control pattern is the equalization pattern (see FIG. 2B), the entire demand object period is decided as the discharge period of the storage battery 40. If, for example, the read control pattern is the specific period emphasis pattern (see FIG. 2C), a specific period established in advance is decided as the discharge period of the storage battery 40 (to simplify the description herein, it is assumed the amount of power stored is entirely used up in the specific period). If, for example, the read control pattern is the desire follow-up pattern (see FIG. 2D), the period decided as the discharge period of the storage battery 40 is a period of a time duration which is obtained by dividing the amount stored in the storage battery 40 by the difference between the expected power consumption calculated in step S2 described above and the electric power the air conditioner 30 can use in the demand object period calculated in step S3 described above immediately prior to the end of the demand object period.

Next, in step S23, the storage battery command generator 27 calculates the discharge amount of the storage battery 40 in the discharge period, based on the read control pattern. If, for example, the read control pattern is the desire-preceding pattern, the specific period emphasis pattern, or the desire follow-up pattern, the amount discharged by the storage battery 40 will be the difference between the expected power consumption calculated in step S2 described above and the electric power the air conditioner 30 can use in the demand object period calculated in step S3 described above. If, for example, the read control pattern is the equalization pattern, the amount discharged by the storage battery 40 in the discharge period will be the quotient of the amount stored in the storage battery 40 divided by the length of the demand request period.

The initial operation requirement of storage battery discharge control is decided in the above manner.

Next, in step S24, a determination is made as to whether or not it is time to start the discharge period of the storage battery. Step S24 is repeated until it is determined that it is time to start the discharge period of the storage battery.

When it is determined that it is time to start the discharge period of the storage battery, the process advances to step S25, and storage battery discharge is started. The storage battery discharge is executed continuously until it is determined in step S26 that the discharge period of the storage battery has ended. When storage battery discharge is started, the storage battery command generator 27 generates a command for the storage battery controller 41 in accordance with the specifics decided in steps S22 and S23, and transmits this command periodically to the storage battery controller 41.

Though not shown in the drawings, when it is determined in step S16, of the air-conditioning restriction control executed in parallel, that the optimization process will be executed, the optimization process of storage battery discharge control is performed by the optimizer 28 with the same timing. In other words, when it is determined in step S16 that the optimization process will be executed, the discharge period of the storage battery and the amount discharged in the discharge period of the storage battery decided in steps S22 and/or S23 are reexamined. The result of the reexamination by the optimizer 28 is reflected in the control of the storage battery 40 executed by the storage battery command generator 27.

(4) Characteristics (4-1)

The air conditioning system 10 of the present embodiment is provided with the air conditioner 30, the storage battery 40, the demand receiver 25, the air conditioner command generator 26 as an example of an air-conditioning controller, and the input unit 23 as an example of the control selector. The air conditioner 30 is run by electric power. The storage battery 40 charges electric power and supplies stored electric power to the air conditioner 30. The demand receiver 25 receives a demand pertaining to the power consumption of the air conditioner 30 during the demand request period. The air conditioner command generator 26 performs air-conditioning restriction control which is preset when there is a need to restrict the operation of the air conditioner 30 in order to satisfy the demand, even when electric power is supplied from the storage battery 40 to the air conditioner 30 in the demand request period. The input unit 23 is configured to enable the selection of the air-conditioning restriction control from among a plurality of control patterns.

Because air-conditioning restriction control, which is executed when the operation of the air conditioner 30 needs to be restricted for complying a demand, is selected in advance from a plurality of control patterns, loss of user comfort can be suppressed according to diverse user's desire.

(4-2)

In the air conditioning system 10 of the present embodiment, the plurality of control patterns include first control patterns (the desire-preceding pattern, the specific period emphasis pattern, and the desire follow-up pattern) in which a period when operation of the air conditioner 30 is not restricted is provided in the demand request period.

Because a period when operation of the air conditioner 30 is not restricted is provided even within the demand request period in a case when the first control pattern (the desire-preceding pattern, the specific period emphasis pattern, or the desire follow-up pattern) is selected as the air-conditioning restriction control, the loss of user comfort can be suppressed according to diverse user's desires.

(4-3)

In the air conditioning system 10 of the present embodiment, the plurality of control patterns include a second control pattern (the equalization pattern) in which the amount of electric power supplied by the storage battery 40 to the air conditioner 30 is kept constant during the predetermined period.

When the second control pattern (the equalization pattern) is selected as the air-conditioning restriction control, rapid change in the temperature of the space being air-conditioned can be suppressed, and loss of comfort of a user, who does not desire sudden changes in temperature, can be suppressed.

(4-4)

The air conditioning system 10 of the present embodiment is further provided with the air-conditioning operation condition perceiver 24 as an example of an operation condition perceiver and the optimizer 28. The air-conditioning operation condition perceiver 24 perceives the operation condition of the air conditioner 30 during the demand request period. The optimizer 28 performs optimization on the air-conditioning restriction control based on the operation condition during the demand request period.

Because optimization of the air-conditioning restriction control is performed based on the operation condition of the air conditioner 30 during the predetermined period, it is particularly easy to suppress loss of user comfort while meeting the demand.

Modifications

Modifications of the above embodiments are presented below. A plurality of modifications may be combined as appropriate.

(5-1) Modification A

In the embodiment above, the air conditioner 30 has an inverter-type compressor 35, but the air conditioner may have a constant-speed compressor. In the air conditioner having a constant-speed compressor, it would not be possible to vary the operating frequency of the compressor in restricting power consumption, and the ratio between time of the compressor being on and time of the compressor being of would therefore be regulated during power consumption restricted periods in the air-conditioning restriction control (including cases of indirectly restricting the ratio between time of the compressor being on and time of the compressor being off by varying the set temperature).

(5-2) Modification B

In the above embodiment, the air conditioning system 10 is provided with a thermostat 20 having a temperature sensor 29, but is not limited thereto.

For example, the air conditioning system 10 may be provided with, instead of the thermostat 20, an adaptor having the same functions as the controller 21 of the thermostat 20 described above. In this case, the air conditioner 30 preferably has a temperature sensor for measuring the room temperature.

In another configuration, for example, the air conditioning system 10 may not have the thermostat 20, and the air conditioner controller 31 or storage battery controller 41 may have the same functions as the controller 21 of the thermostat 20 described above. Yet, in another configuration, the air conditioner controller 31 may have some of the functions of the controller 21 of the thermostat 20, while the storage battery controller 41 may have the other functions of the controller 21 of the thermostat 20. In this case, the air conditioner 30 preferably has a temperature sensor for measuring the room temperature.

In another option, for example, even when the air conditioning system 10 has the thermostat 20, the air conditioner controller 31 and/or the storage battery controller 41 may have some or all of the functions of the controller 21 of the thermostat 20 described above.

(5-3) Modification C

In the above embodiment, the process of deciding the control implemented in the demand request period and the subsequent series of processes are started on the requirement that the demand receiver 25 receives a demand, but are not limited to doing so. For example, the air conditioner command generator 26 may be configured so as to start the process of deciding the control implemented in the demand request period and the subsequent series of processes at a prescribed time prior to the starting time of the demand request period.

(5-4) Modification D

The control patterns presented in the above embodiment are merely examples, and the control patterns are not limited to those of the above embodiment. For example, the control patterns may include a pattern in which periods of operating the air conditioner at the air-conditioning capacity desired by the user are provided both immediately after the start and immediately before the end of the demand request period. The control patterns may also include, e.g., a pattern in which the air-conditioning capacity is reduced throughout the entire demand request period similar to the equalization pattern, but the electric power supplied from the storage battery to the air conditioner is fluctuated depending on the time span.

The present invention is useful as an air conditioning system in which electric power stored in a storage battery is utilized in an air conditioner in accordance with a demand, wherein loss of the comfort of the user of the air conditioner can be suppressed even when the capacity of the air conditioner is reduced below the air-conditioning capacity desired by the user in order to meet the demand.

What is claimed is:

1. An air conditioning system, comprising:

an air conditioner configured to be run by electric power from a power source;

a storage battery configured to store electric power from the power source and to supply the stored electric power to the air conditioner;

a demand receiver configured to receive a demand pertaining to a power consumption of the electric power from the power source by the air conditioner during a predetermined period;

an air-conditioning controller configured to perform air-conditioning restriction control when the stored electric power in the storage battery is insufficient to satisfy the demand such that there is a need to restrict operation of the air conditioner in order to satisfy the demand, the air-conditioning controller storing a plurality of restriction control patterns, the air-conditioning restriction control being based on a preset restriction control pattern selected in advance from among the plurality of restriction control patterns, the restriction control patterns defining how the air-conditioning restriction control will be executed during the predetermined period;

a control selector configured to receive input from a user to select one of the restriction control patterns from among the plurality of stored restriction control patterns to be used as the preset restriction control pattern; and a storage battery controller configured to control discharge of the storage battery, the storage battery controller being configured to control discharge of the storage battery based on the preset restriction control pattern when there is a need to restrict operation of the air conditioner in order to satisfy the demand.

2. The air conditioning system according to claim 1, wherein the plurality of restriction control patterns include a first control pattern in which a period when operation of the air conditioner is not restricted is provided in the predetermined period.

3. The air conditioning system according to claim 2, wherein the plurality of restriction control patterns include a second control pattern in which an amount of electric power supplied by the storage battery to the air conditioner is kept constant during the predetermined period.

4. The air conditioning system according to claim 2, further comprising:

an operation condition perceiver configured to perceive an operation condition of the air conditioner during the predetermined period; and an optimizer configured to perform optimization of the air-conditioning restriction control based on the operation condition during the predetermined period.

5. An air conditioning system, comprising:

an air conditioner configured to be run by electric power from a power source;

a storage battery configured to store electric power from the power source and to supply the stored electric power to the air conditioner;

a demand receiver configured to receive a demand pertaining to a power consumption of the electric power from the power source by the air conditioner during a predetermined period;

an air-conditioning controller configured to perform air-conditioning restriction control when the stored electric power in the storage battery is insufficient to satisfy the demand such that there is a need to restrict operation of the air conditioner in order to satisfy the demand, the air-conditioning restriction control being based on a preset restriction control pattern;

a control selector enabling a user to select a restriction control pattern from among a plurality of stored restriction control patterns to be used as the preset restriction control pattern, the restriction control patterns defining how the air-conditioning restriction control will be executed during the predetermined period, the plurality of restriction control patterns including a second control pattern in which an amount of electric power supplied by the storage battery to the air conditioner is kept constant during the predetermined period; and a storage battery controller configured to control discharge of the storage battery, the storage battery controller being configured to control discharge of the storage battery based on the preset restriction control pattern when there is a need to restrict operation of the air conditioner in order to satisfy the demand.

6. The air conditioning system according to claim 5, further comprising:

an operation condition perceiver configured to perceive an operation condition of the air conditioner during the predetermined period; and an optimizer configured to perform optimization of the air-conditioning restriction control based on the operation condition during the predetermined period.

7. The air conditioning system according to claim 1, further comprising:

an operation condition perceiver configured to perceive an operation condition of the air conditioner during the predetermined period; and an optimizer configured to perform optimization of the air-conditioning restriction control based on the operation condition during the predetermined period.

8. The air conditioning system according to claim 2, wherein the period when operation of the air conditioner is not restricted spans from a start of the predetermined period until the electric power stored in the storage battery is used up.

9. The air conditioning system according to claim 2, wherein the period when operation of the air conditioner is not restricted is a specific period within the predetermined period, the specific period spanning from a time after a start of the predetermined period and ending before an end of the predetermined period.

10. The air conditioning system according to claim 2, wherein the period when operation of the air conditioner is not restricted spans from a time after a start of the predetermined period until an end of the predetermined period.

* * * * *